US008453736B2

(12) United States Patent
Constantine

(10) Patent No.: US 8,453,736 B2
(45) Date of Patent: Jun. 4, 2013

(54) METHOD AND APPARATUS FOR STIMULATING PRODUCTION IN A WELLBORE

(75) Inventor: Jesse J. Constantine, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 326 days.

(21) Appl. No.: 12/950,552

(22) Filed: Nov. 19, 2010

(65) Prior Publication Data

US 2012/0125626 A1 May 24, 2012

(51) Int. Cl.
*E21B 34/06* (2006.01)

(52) U.S. Cl.
USPC ..... 166/291; 166/307; 166/177.5

(58) Field of Classification Search
USPC ..... 166/291, 306, 307, 177.5
See application file for complete search history.

(56) References Cited

U.S. PATENT DOCUMENTS

| | | | | |
|---|---|---|---|---|
| 6,394,184 | B2 * | 5/2002 | Tolman et al. | 166/281 |
| 7,681,645 | B2 * | 3/2010 | McMillin et al. | 166/291 |
| 2012/0067583 | A1 * | 3/2012 | Zimmerman et al. | 166/308.1 |

FOREIGN PATENT DOCUMENTS

| | | | |
|---|---|---|---|
| EP | 1184537 | A2 | 3/2002 |
| EP | 2192507 | A1 | 6/2010 |
| WO | WO2007134597 | A1 | 11/2007 |

* cited by examiner

*Primary Examiner* — William P Neuder
(74) *Attorney, Agent, or Firm* — Cantor Colburn LLP

(57) ABSTRACT

In an aspect, method for stimulating fluid flow in a wellbore is provided, the method including placing a fluid jetting valve in a tubular, conveying the tubular in a wellbore with the fluid jetting valve in a closed position and changing a pressure within the tubular to move the fluid jetting valve to an open position. In addition, the method includes directing a stimulation fluid through the open fluid jetting valve into a wall of the wellbore and moving the fluid jetting valve to a permanently closed position via a passive control device.

20 Claims, 5 Drawing Sheets

METHOD AND APPARATUS FOR STIMULATING PRODUCTION IN A WELLBORE

BACKGROUND

To form a wellbore or borehole in a formation, a drilling assembly (also referred to as the "bottom hole assembly" or the "BHA") carrying a drill bit at its bottom end is conveyed downhole. The wellbore may be used to store fluids in the formation or obtain fluids from the formation, such as hydrocarbons. Several techniques may be employed to stimulate hydrocarbon production in the formation. For example, an acid may be flowed downhole within a tubular disposed in the wellbore, wherein holes in the tubular are used to release the acid into the wellbore to treat the formation and stimulate fluid flow into or from the formation. Further, after release of the acid from the tubular, hydrocarbons are received by the tubular. It is beneficial to receive the hydrocarbons through inflow control devices, where the inflow control devices can be adjusted for wellbore conditions and other factors. Accordingly, the tubular holes for acid flow and stimulation reduce control over hydrocarbon flow within the tubular.

SUMMARY

In one aspect, a method for stimulating fluid flow in a wellbore is provided, the method including placing a fluid jetting valve in a tubular, conveying the tubular in a wellbore with the fluid jetting valve in a closed position and changing a pressure within the tubular to move the fluid jetting valve to an open position. In addition, the method includes directing a stimulation fluid through the open fluid jetting valve into a wall of the wellbore and moving the fluid jetting valve to a permanently closed position via a passive control device.

In one aspect, an apparatus for stimulating fluid flow in a wellbore is provided, wherein the apparatus includes a fluid jetting valve to be placed in a tubular, the fluid jetting valve configured to flow stimulation fluid into a formation when placed in the wellbore. The apparatus further includes a passive control device located in the fluid jetting valve, wherein the passive control device is configured to close the fluid jetting valve at a selected condition.

BRIEF DESCRIPTION OF THE DRAWING

The disclosure herein is best understood with reference to the accompanying figures in which like numerals have generally been assigned to like elements and in which.

DETAILED DESCRIPTION

Figure 1:
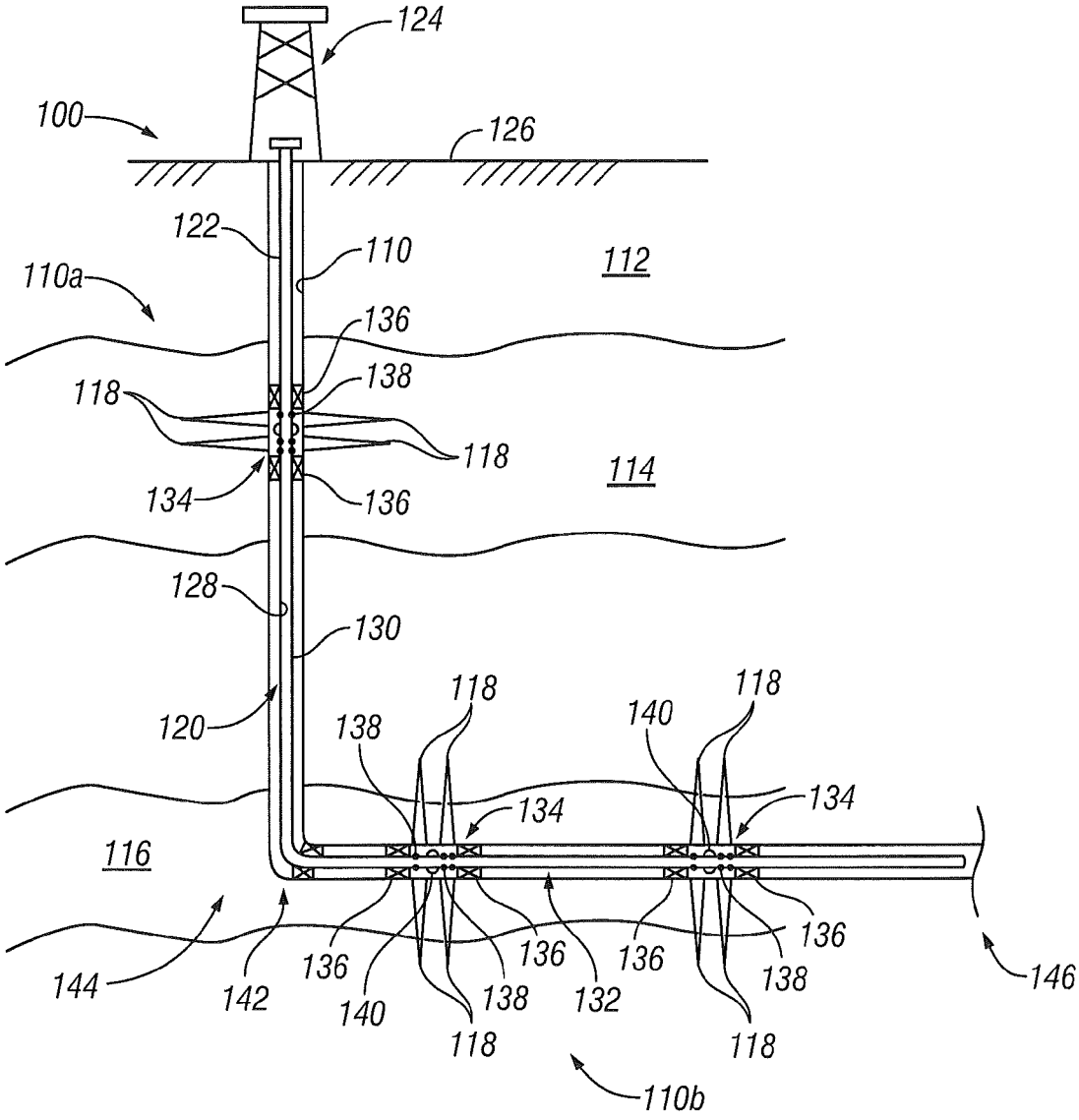
FIG. 1 is a schematic view of an embodiment of a wellbore system that includes production assemblies and fluid jetting valves.

Referring initially to FIG. 1, there is shown an exemplary production wellbore system 100 that includes a wellbore 110 drilled through an earth formation 112 and into production zones or reservoirs 114 and 116. The wellbore 110 is shown lined with an optional casing having a number of perforations 118 that penetrate and extend into the formations production zones 114 and 116 so that production fluids may flow from the production zones 114 and 116 into the wellbore 110. The exemplary wellbore 110 is shown to include a vertical section 110*a* and a substantially horizontal section 110*b*. The wellbore 110 includes a production string (or production assembly) 120 that includes a tubular (also referred to as the tubing or base pipe) 122 that extends downwardly from a wellhead 124 at surface 126 of the wellbore 110. The production string 120 defines an internal axial bore 128 along its length. An annulus 130 is defined between the production string 120 and the wellbore 110, which may be an open or cased wellbore depending on the application. The production string 120 is shown to include a generally horizontal portion 132 that extends along the deviated leg or section 110*b* of the wellbore 110. Production assemblies 134 are positioned at selected locations along the production string 120. Optionally, each production assembly 134 may be isolated within the wellbore 110 by a pair of packer devices 136. Although only two production assemblies 134 are shown along the horizontal portion 132, a large number of such production assemblies 134 may be arranged along the horizontal portion 132. In addition, a packer 142 may be positioned near a heel 144 of the wellbore 110, wherein element 146 refers to a toe of the wellbore. Packer 142 isolates the horizontal portion 132, thereby enabling pressure manipulation to control fluid flow in wellbore 110.

As depicted, each production assembly 134 includes one or more fluid jetting valve 138 made according to one embodiment of the disclosure to control flow of one or more stimulation fluids from the production string 120 into the production zones 114, 116. In addition, each production assembly 134 includes one or more inflow control devices 140 to control flow of one or more fluids from the production zones 118 into the production string 120. As used herein, the term "fluid" or "fluids" includes liquids, gases, hydrocarbons, multi-phase fluids, mixtures of two of more fluids, water and fluids injected from the surface, such as water or stimulation fluids. Additionally, references to water should be construed to also include water-based fluids; e.g., brine, sea water or salt water. Stimulation fluids may include any suitable fluid used to reduce or eliminate an impediment to fluid production without fracturing or damaging the formation. For example, a skin may form on the wall when a wellbore is formed in a limestone formation. A stimulation fluid, such as hydrochloric acid (HCl) or mud acid may be injected into the wellbore to remove the skin and enable production of fluids from the formation.

In an embodiment, a flow of stimulation fluid is flowed from the surface 126 within production string 120 (also referred to as "production tubular") to production assemblies 134. Fluid jetting valves 138 are positioned throughout the production string 120 to distribute stimulation fluid based on formation conditions and desired production. In one exemplary embodiment, four fluid jetting valves 138 are located within the production assembly 134 near heel 144, while eight fluid jetting valves 138 are located within the production assembly 134 near toe 146. In an embodiment, the fluid jetting valves 138 are in a closed position during run-in or installation to prevent fluid flow between the wellbore 110 and production string 120. The fluid jetting valves 138 remain in a closed position when a selected pressure level within the production string 120 is maintained. Accordingly, a change in pressure within the production string 120, such as an increased pressure or decreased pressure, moves the fluid jetting valves 138 to an open position, thereby allowing a flow of stimulation fluid from the production string 120 into the wellbore 110. The injection of stimulation fluid causes removal of impediments in the wellbore 110 to allow flow of formation fluid. After flowing the stimulation fluid in the wellbore, the fluid jetting valves 138 are closed to enable formation fluid to flow into the production string through inflow control devices 140. In addition, the open or closed position of the fluid jetting valves 138 is controlled locally. Thus, the fluid jetting valves 138 operate independent of components at the surface 126. As discussed in detail below, exemplary fluid jetting valves 138 are controlled locally by a passive control device that enables control without a connection to the surface, thereby reducing equipment to save money and space.

Figure 2:
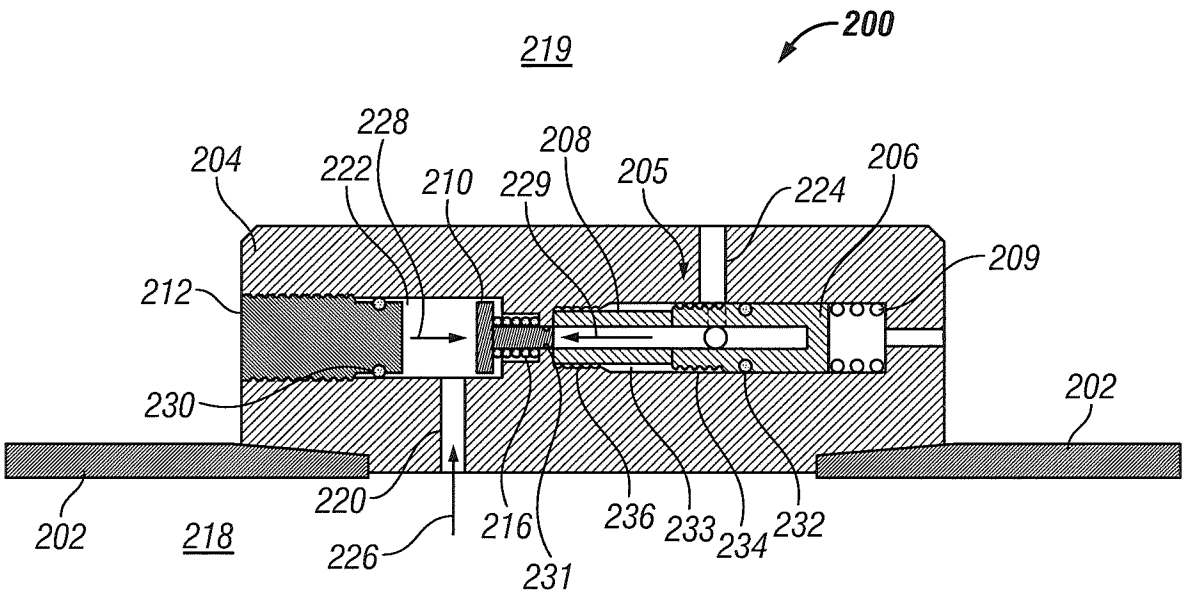
FIG. 2 is a sectional side view of an embodiment of a fluid jetting valve in a closed and running-in position.
Figure 3:
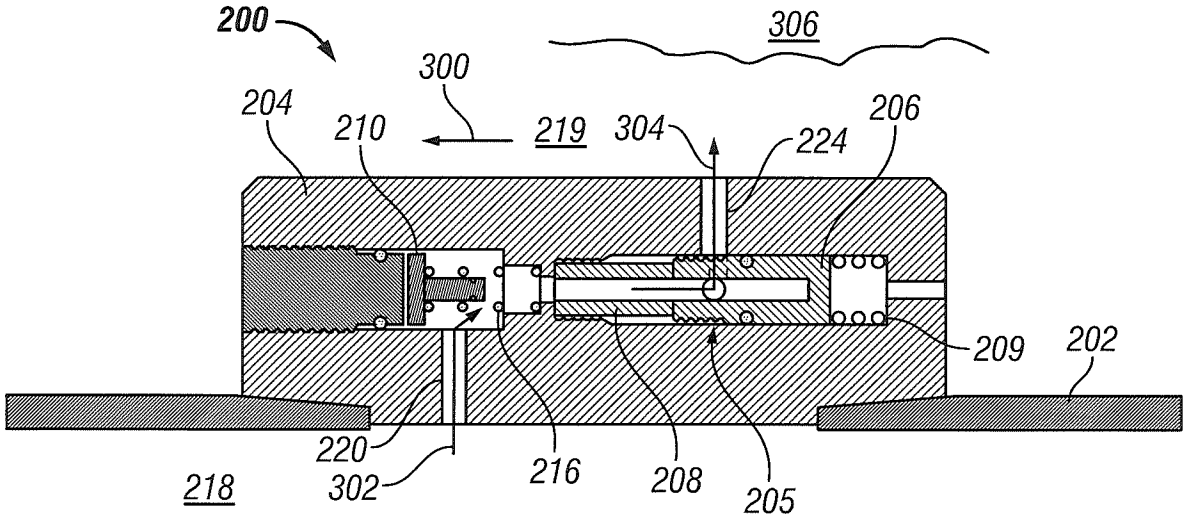
FIG. 3 is a sectional side view of the fluid jetting valve from FIG. 2 in an open position.
Figure 4:
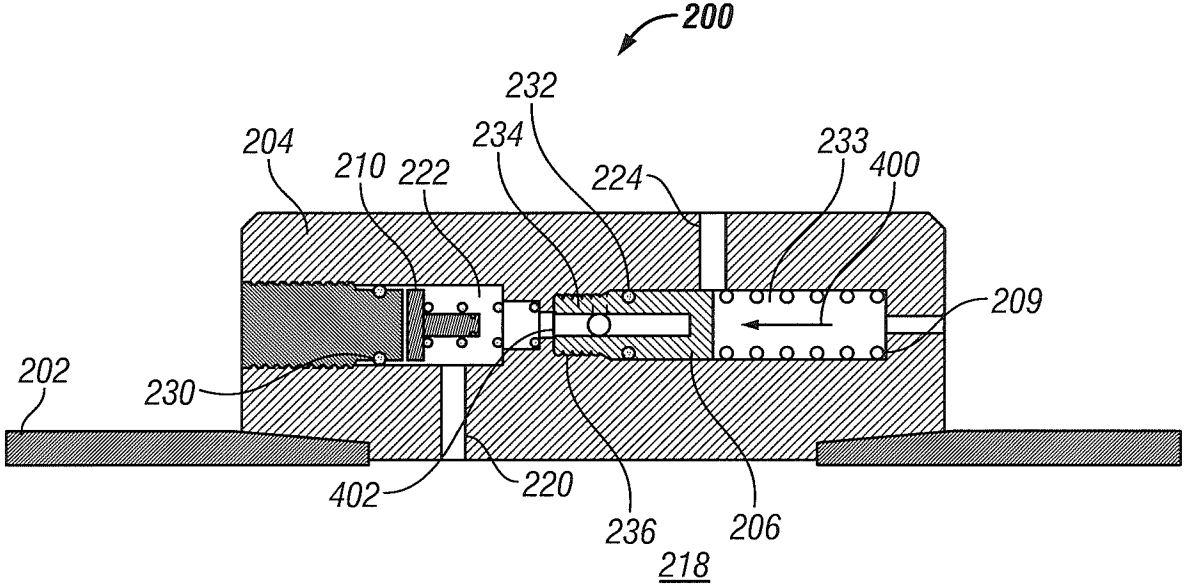
FIG. 4 is a sectional side view of the fluid jetting valve from FIG. 2 in a permanently closed position.

FIGS. 2-4 are sectional side views of an exemplary fluid jetting valve 200 positioned on a portion of tubular 202. The fluid jetting valve 200 includes a body 204, passive control device 205, multi-tasking valve 210, end cap 212, and biasing member 216. The body 204 may be any suitable shape and material to withstand high temperatures and pressures downhole. Exemplary materials include stainless steel and steel alloys. As depicted, the passive control device 205 includes a piston 206, dissolvable member 208 and biasing member 209, which are located inside body 204. In the embodiment of FIG. 2, fluid jetting valve 200 is in a closed position, wherein there is no fluid communication from an annulus 218 of tubular 202 to wellbore annulus 219, via passage 220, cavity 222 and passage 224. Further, the multi-tasking valve 210 is in a closed position due to high pressure fluid 226 from within annulus 218. The high pressure fluid 226 urges or moves the multi-tasking valve 210 closed in a direction 228, thereby compressing biasing member 216. In addition, the biasing member 209 urges the piston 206 in direction 229 due to the fact that there is no pressurized fluid flow through the closed multi-tasking valve 210. The fluid jetting valve 200 also includes seals 230, 231 and 232 to prevent fluid flow in selected areas of the valve. For example, seal 231 prevents fluid flow from cavity 222 into cavity 233 when in the closed position illustrated in FIG. 2. Exemplary seals 230, 231 and 232 include O-rings or other suitable and durable sealing devices.

In an exemplary embodiment of fluid jetting valve 200, a mechanism, such as a shearing pin, maintains a closed position for the valve to prevent fluid communication between annulus 218 and wellbore annulus 219. In a subsequent step, an increase in pressure inside tubular 202 shears the shearing pin, causing multi-tasking valve 210 to open in direction 300, as depicted in FIG. 3. A stimulation fluid 302 flows from annulus 218, through multi-tasking valve 200 and into wellbore annulus 219, as depicted by arrow 304. Further, the shearing of the shearing pin enables the biasing member 216 to expand, urging multi-tasking valve 210 in direction 300. In the depicted embodiment, dissolvable member 208 and piston 206 include fluid flow passages for fluid communication with passage 224 and wellbore cavity 219. The passive control device 205 includes the piston 206 positioned between the compressed biasing member 209 and dissolvable member 208, wherein the passive control device 205 is configured to allow a selected amount of stimulation fluid to flow through the fluid jetting valve 200 before moving to a permanently closed position, shown in FIG. 4.

The exemplary fluid jetting valve 200 of FIG. 4 includes piston 206 urged in a closing direction 400 by biasing member 209. The dissolvable member 208 (FIG. 2) has been dissolved by a flow of stimulation fluid, thereby allowing the piston 206 to be urged against wall 402 of cavity 233 by biasing member 209. Accordingly, the passive control device 205 includes the dissolvable member 208 configured to dissolve as it is exposed to the stimulation fluid over time, thereby passively sealing the fluid jetting valve 200 in the permanently closed position. The permanently closed position of fluid jetting valve 200 prevents fluid communication through the valve during production of formation fluid received through inflow control devices 140 (FIG. 1), reducing pressure fluctuations and thereby improving control over production. In an embodiment, the stimulation fluid is an acid configured to remove impediment or restrictions in a formation and the dissolvable member 208 comprises a material that dissolves or breaks down as it is exposed to the acid. Exemplary materials for dissolvable member 208 include alloys made with Aluminum, Magnesium, Tin-Lead, Zinc and/or Gold. Thus, the dissolvable member 208 is designed to enable a selected amount of acid to flow through fluid jetting valve 200 before the member dissolving and the piston 206 moves to the permanently closed position. The exemplary fluid jetting valve 200 provides a flow control mechanism that changes between a closed position (FIG. 2) to an open position (FIG. 3) and then to a permanently closed position (FIG. 4) without a communication or control line from the surface, thereby simplifying the wellbore stimulation process. The passive control devices 208 may include any suitable mechanisms to independently control the position of the fluid jetting valve 200 to control stimulation fluid flow from the tubular 202 into the wellbore annulus 219.

A method for operating an exemplary fluid jetting valve 200 is now described with continued reference to FIGS. 2-4. A change in pressure within tubular 202 causes the multi-tasking valve 210 to open via a suitable mechanism, such as a shearing pin with an increase in pressure. With the multi-tasking valve 210 open (FIG. 3), tubular 202 pressure causes piston 206 to slide or move, providing a path between the tubing annulus 218 and formation surface 306 for the flow of stimulation fluid. In an embodiment, other fluids, including seawater, may flow through the fluid jetting valve 200 to wash the stimulation fluid from the wellbore annulus 219 prior to flow of production fluid. As long as the pressure inside tubular 202 exceeds a formation pressure in wellbore annulus 219, the fluid jetting valve 200 remains open, allowing fluid flow from the tubular 202 to the formation surface 306. In the event of pump shutdown or other issues, the pressure difference would reverse, where formation pressure exceeds tubular 202 pressure, and the piston 206 moves back to the closed position, preventing formation-exposed fluid from passing through the fluid jetting valve 200. Once the stimulation and seawater wash steps are complete, the dissolvable member 208 dissolves due to exposure to the fluids, allowing the piston 206 to move into a locking device, such as collet structure 234 and mating structure 236, which permanently lock piston 206 in a closed position (FIG. 4).

Figure 5:
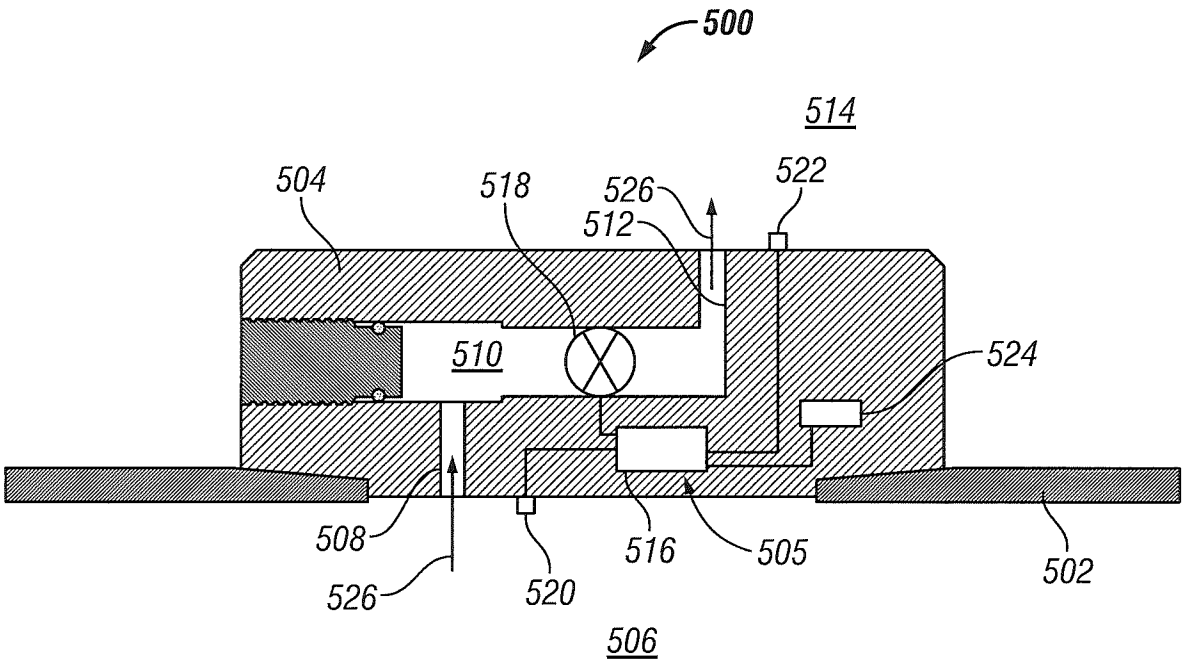
FIG. 5 is a sectional side view of another embodiment of fluid jetting valve.

FIG. 5 is a side sectional view of another embodiment of a fluid jetting valve 500 positioned on a tubular 502. The fluid jetting valve 500 includes a body 504 and passive control device 505. The body 504 may be any suitable shape and material to withstand high temperatures and pressures downhole. The passive control device 505 is configured to control fluid communication from annulus 506, through passage 508, cavity 510, passage 512 and into wellbore annulus 514. The exemplary passive control device 505 includes a controller 516, flow control device 518, sensor 520, sensor 522 and power source 524. The passive control device 505 is configured to operate independently of surface control to control fluid flow 526 from the tubular 502 into the wellbore annulus 514. The controller 516 may include an application specific integrated circuit (ASIC), an electronic circuit, a processor (shared, dedicated or group) and memory that executes one or more software of firmware programs, a combinational logic circuit, and/or other suitable components that provide the described functionality. For example, controller 516 includes an analog-to-digital converter circuit that is configured to receive signals from sensors 520 and 522, wherein the signals are processed to determine sensed parameters. The controller 516 also includes hardware and software to input sensed parameters into an algorithm, comparison routine or other function to control an open or closed state for flow control device 518.

Exemplary sensors 520 and 522 include pH, temperature or pressure sensors, wherein changes in corresponding parameters determine an open or closed position for flow control device 518 and fluid jetting valve 500. Specifically, an exemplary sensor 522 is a pH sensor that detect the presence of a fluid, such as HCl, and/or a subsequent seawater wash, thereby allowing the flow control device 518 to be closed once the desired stimulation and washing operation is complete and confirmed by the detected pH measurement. The exemplary passive control device 505 allows flow control device 518 to close after the stimulation fluid is washed away with seawater. Another embodiment includes a temperature sensor 522, wherein a selected temperature or change in temperature in wellbore annulus 514 corresponds to heat caused by a chemical reaction between the stimulation fluid, formation and impediments on the formation wall. As the controller 516 receives the signal from temperature sensor 522, controller 516 processes the temperature to determine the corresponding open or closed position the flow control device 518. For example, the flow control device 518 is open sensor 522 and controller 516 may determine a downhole temperature at or above about 130 degrees Celsius when the stimulation fluid is reacting with the formation wall and skin. The controller 516 may then detect a lower temperature of about 80 degrees C. when seawater is used to flush the wellbore at which time a timer in controller counts down a selected time, such as two hours, before closing flow control device 518.

In yet another embodiment, the controller 516 provides control over the flow control device 518, wherein the power source 514 provides a selected amount of power to the controller 516 and device 518. In the embodiment, an increase in pressure causes flow control device 518 to open via a suitable mechanism, such as a shearing pin or reed, wherein the mechanism activates or "wakes" the controller 516 to open the flow control device 518. In other embodiments, the mechanism reacts to the pressure change to physically move the flow control device 518 to an open position. The flow control device 518 is maintained in an open position as power is provided to the device 518 from power source 524 via controller 516. The flow control device 518 closes when it does not receive power. In addition, the flow control device 518 may be an electrically and/or mechanically actuated valve, such as an electromagnetic valve, where a selected amount of current moves the valve to an open position. Thus, the power source 524 serves as a timer, where the power source 524 lasts for a selected period of time and closes the flow control device 518 when power runs out. Thus, the passive control device 505 is configured to use a selected power source 524 coupled to the flow control device 518 to independently or locally control fluid flow through the fluid jetting valve 500. In another embodiment, the passive control device 505 includes a permanent magnet used to control the flow control device 518, wherein a strength of a magnetic field is reduced over time due to exposure to selected elevated temperatures, known as the Curie temperature for the magnet. Thus, as the magnet is exposed to high temperatures, the magnet loses strength and moves the flow control device 518 to a closed position. These types of arrangements for passive control device 505 may be described as fail-safe configurations, wherein a default position for the flow control device is closed.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. A method for stimulating fluid flow in a wellbore, comprising:

placing a fluid jetting valve in a tubular;

conveying the tubular in a wellbore with the fluid jetting valve in a closed position;

changing a pressure within the tubular to move the fluid jetting valve to an open position;

directing a stimulation fluid through the open fluid jetting valve into a wall of the wellbore; and moving the fluid jetting valve to a permanently closed position via a passive control device, wherein the passive control device is not controlled by a connection to a surface of the wellbore.

2. The method of claim 1, wherein moving the fluid jetting valve to a closed position comprises moving the passive control device to a closed position without control from the surface.

3. The method of claim 1, wherein moving the fluid jetting valve to a closed position comprises dissolving a member of the passive control device as the member is exposed to the stimulation fluid.

4. The method of claim 1, wherein moving the fluid jetting valve to a closed position comprises closing a fluid flow via the passive control device after being in the open position for a selected time period.

5. The method of claim 1, wherein moving the fluid jetting valve to a closed position comprises sensing a parameter to determine when to close the fluid jetting valve.

6. The method of claim 5, wherein the parameter comprises a pH of a fluid flowing in the wellbore.

7. The method of claim 1, wherein changing the pressure comprises increasing the pressure.

8. An apparatus for stimulating fluid flow in a wellbore, comprising:

a tubular;

a fluid jetting valve to be placed in the tubular;

a stimulation fluid supply in fluid communication with the fluid jetting valve; and a passive control device located in the fluid jetting valve, wherein the passive control device is configured to close the fluid jetting valve and the passive control device is not controlled by a connection to a surface of the wellbore.

9. The apparatus of claim 8, wherein the passive control device comprises a device that is not controlled from the surface.

10. The apparatus of claim 8, wherein the passive control device comprises a member that dissolves as the member is exposed to the stimulation fluid.

11. The apparatus of claim 8, wherein the passive control device comprises a timing device that closes the fluid jetting valve after being open for a selected time period.

12. The apparatus of claim 8, wherein the passive control device comprises a sensing device that closes the fluid jetting valve based on a determined parameter.

13. The apparatus of claim 12 wherein the parameter comprises a pH of a fluid.

14. The apparatus of claim 12 wherein the parameter comprises a temperature of a fluid.

15. The apparatus of claim 8, wherein the stimulation fluid comprises an acidic solution.

16. The apparatus of claim 8, wherein the passive control device comprises a power source and a flow control device that is open when powered and closed when not powered.

17. An apparatus for stimulating fluid flow in a wellbore, comprising:

a fluid jetting valve to be placed in a tubular, the fluid jetting valve configured to flow stimulation fluid into a formation when placed in the wellbore; and a passive control device located in the fluid jetting valve, wherein the passive control device is configured to close the fluid jetting valve at a selected condition and the passive control device is not controlled by a connection to a surface of the wellbore.

18. The apparatus of claim 17, wherein the selected condition is one from the group consisting of: a determined pH, a determined temperature and a time period.

19. The apparatus of claim 17, wherein the passive control device comprises a dissolvable member and wherein the selected condition is the dissolving of the dissolvable member.

20. The apparatus of claim 17, wherein the passive control device comprises a device that is not controlled from the surface.

* * * * *